US005184535A

United States Patent [19]

Kimura

[11] Patent Number: 5,184,535

[45] Date of Patent: Feb. 9, 1993

[54] SPEED CONTROL DEVICE FOR A PNEUMATIC CYLINDER

[76] Inventor: Takashi Kimura, 84-7, Mizukiri-cho 5-chome, Kita-ku, Nagoya-shi, Aichi-ken, Japan

[21] Appl. No.: 719,759

[22] Filed: Jun. 24, 1991

[30] Foreign Application Priority Data

Jul. 13, 1990 [JP] Japan ..... 2-185908
May 13, 1991 [JP] Japan ..... 3-033145[U]

[51] Int. Cl.[5] ..... F15B 11/08

[52] U.S. Cl. ..... 91/443; 91/444; 91/447; 91/448; 91/433; 91/461; 137/596.16; 137/627.5; 60/370; 60/415

[58] Field of Search ..... 91/443, 444, 433, 461, 91/447, 448; 137/596.16, 627.5; 60/370, 413, 486

[56] References Cited

U.S. PATENT DOCUMENTS 3,171,331 3/1965 Samuel ..... 91/443 X
3,991,570 11/1976 Keller ..... 60/413
4,018,050 4/1977 Murphy ..... 60/370
4,175,473 11/1979 Iizumi ..... 91/443
4,262,695 4/1981 Iizumi ..... 91/443 X
5,065,665 11/1991 Kimura ..... 91/433

FOREIGN PATENT DOCUMENTS 2154873 6/1990 Japan .

*Primary Examiner*—Edward K. Look
*Assistant Examiner*—Todd Mattingly
*Attorney, Agent, or Firm*—Davis, Bujold & Streck

[57] ABSTRACT

A speed control device for a pneumatic cylinder of the invention is characterized in that a speed control of the pneumatic cylinder can be changed from air pressure to air mass flow by a two-way valve and an airflow control valve. Therefore, an ordinary and low moving speed of a load is maintained even if the load changes its speed or stops moving, and thus any accidents caused by a change of the moving speed of the load are prevented beforehand. Additionally, since in this invention only a two-way valve and an airflow control valve are added to a conventional pneumatic cylinder and high relief type pressure reducing valve, the device of the invention is simply constructed and has a wide variety of usage. Furthermore, since the device of the invention is provided with a pressure accumulator and a checking valve, the pneumatic cylinder can be stably controlled even when the load moves at a high speed.

10 Claims, 7 Drawing Sheets

SPEED CONTROL DEVICE FOR A PNEUMATIC CYLINDER

BACKGROUND OF THE INVENTION

This invention relates to a speed control device for a pneumatic cylinder.

In a conventional pneumatic cylinder carrying a load, the moving speed of the piston rod is controlled by air pressure employing a high relief type pressure reducing valve. The slide resistance of the piston rod may change during its stroke due to various external forces such as curvature of the piston rod itself. Accordingly, the speed of the piston rod may change, or in an extreme case, the piston rod may stop altogether.

SUMMARY OF THE INVENTION

Wherefore, an object of this invention is to provide a speed control device for a pneumatic cylinder which solves the aforementioned problem.

Another object of the invention is to provide a speed control device for a pneumatic cylinder, in which air pressure for controlling a high relief type pressure reducing valve is sufficiently supplied even if air pressure for driving the pneumatic cylinder is insufficient. Thus, this speed control device for a pneumatic cylinder can securely drive the pneumatic cylinder at an enhanced driving speed.

To achieve this object, the present invention employs a construction as set forth below. Namely, the high relief type pressure reducing valve comprises: a first pressure chamber connecting with an air pressure supply, a second pressure chamber communicating with a port of a pneumatic cylinder, and an exhaust chamber connected to the outside air. The second pressure chamber can be connected to and disconnected from the first pressure chamber and the exhaust chamber by a control valve and can attain a plurality of pressure controls. A two-way valve and an airflow control valve are placed in parallel in the middle of either an air supply passage or an exhaust passage connecting the pressure reducing valve and the pneumatic cylinder. Speed control of the pneumatic cylinder can be changed from air pressure to air mass flow by the two-way valve and the airflow valve.

Furthermore, the high relief type pressure reducing valve and the pneumatic cylinder are connected or disconnected by controlling valve members within the pressure reducing valve by means of air pressure supplied from a pilot line branching from a main line. A pressure accumulator and a checking valve for preventing reverse airflow from the pilot line to the main line are provided in the pilot line and between the pressure accumulator and the main line, respectively.

When a load moves at a low speed in combination with the piston rod of the pneumatic cylinder, the pressure of the second pressure chamber of the pneumatic cylinder almost equilibrates with a pre-determined pressure in the pressure reducing valve. The contact area of the first pressure chamber and the second pressure chamber or the contact area of the second pressure chamber and the exhaust chamber is small. Air is regularly supplied into the pneumatic cylinder through the small contact area, the two-way valve, the first pressure chamber and the second pressure chamber. Air is also regularly exhausted from the pneumatic cylinder into the exhaust chamber via the second pressure chamber. If, after a period of time, the moving speed of the load decreases due to an increase in slide resistance of the piston or an associated part; or, the load stops. the contact area mentioned above becomes larger by controlling the high relief type pressure reducing valve. The pressure reducing valve then comes into a supplying condition or an exhausting condition and thus air flows easily in the pressure reducing valve. Meanwhile, since the two-way valve is closed, air mass flow is controlled by the airflow control valve. In this way, a speed controlling means for the piston in the pneumatic cylinder is changed from air pressure to air mass flow. Consequently, the movement of the load again becomes an ordinary one.

The pilot line is kept supplied with air pressure by means of the pressure accumulator. The checking valve prevents reverse airflow from the pilot line into the main line. The air pressure in the pilot line is thus maintained even when the air pressure in the main line is scanty. Therefore, the pressure reducing valve is stably controlled, and the pneumatic cylinder keeps normal operations even when the speed of the movement is high.

DETAILED DESCRIPTION OF THE PREFERRED EMBODIMENTS

Preferred embodiments of the invention are hereinbelow described in detail with reference to the following drawings.

EMBODIMENT 1

Figure 1:
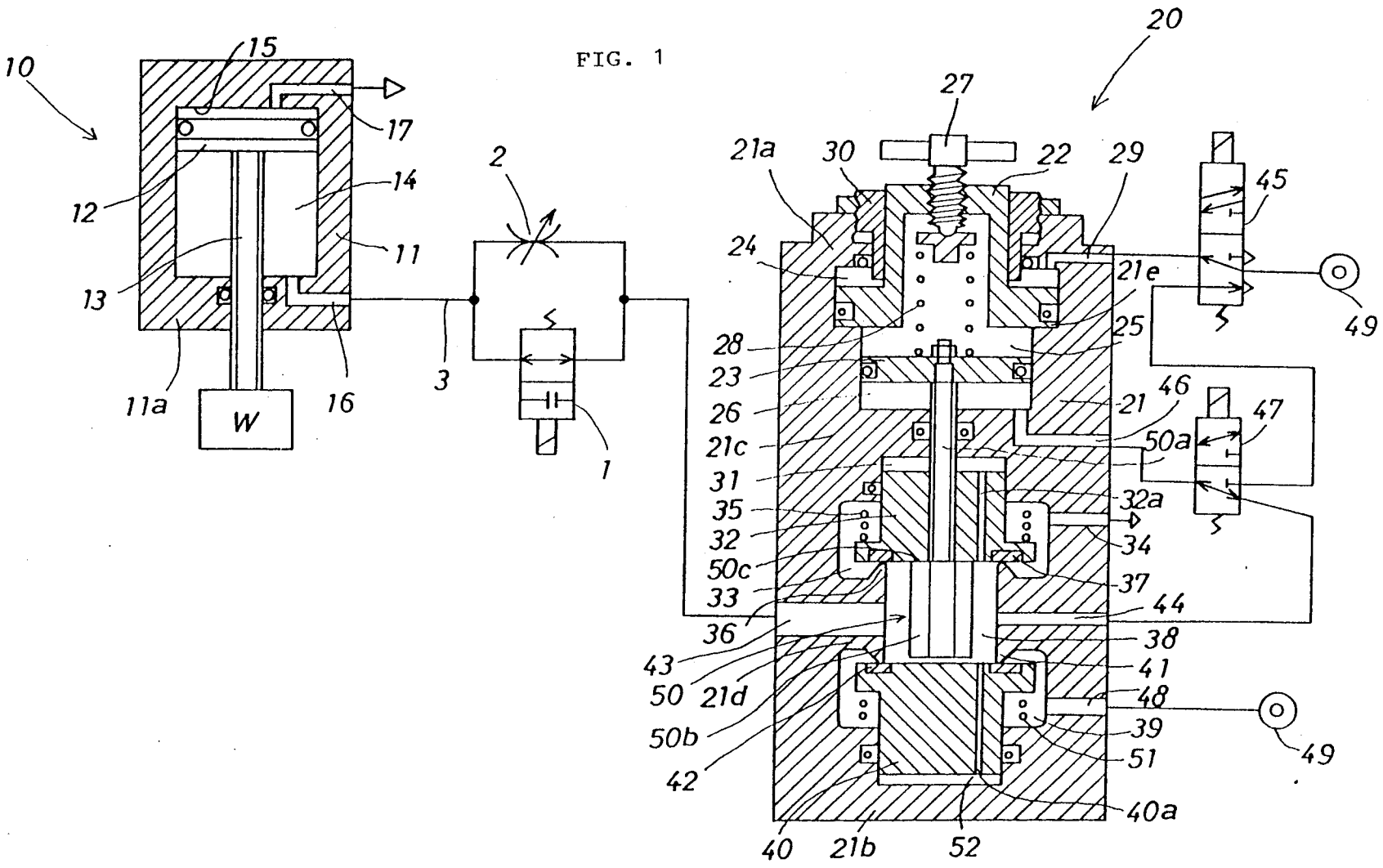
FIG. 1 is a front view of a first embodiment of the present invention.

FIG. 1 corresponds to the first embodiment. In FIG. 1, a speed control device of a pneumatic cylinder comprises a pneumatic cylinder 10, a high relief type pressure reducing valve 20, a two-way valve 1, and an airflow control valve 2. The two way valve 1 and the airflow control valve 2 are positioned in parallel and connect the pneumatic cylinder 10 and the pressure reducing valve 20.

The pneumatic cylinder 10 slidably accommodates a piston 12 in a case member 11. A piston rod 13 slidably penetrates an end wall 11*a* of the case member 11 carrying a load W at the end of the piston rod 13. The pneumatic cylinder 10 further comprises a rod side chamber 14, a head side chamber 15, a rod port 16 and a head port 17.

The high relief type pressure reducing valve 20 comprises a first separating wall 21*c* and a second separating wall 21*d* in a cylindrical case member 21. A hat-shaped balance piston 22 and a pressure control piston 23 are slidably accommodated in a cavity formed by the first separating wall 21*c* and a top wall 21*a*. The balance piston 22 can also slide through a screw member 30 mounted on the top wall 21*a*. A space between the balance piston 22 and the top wall 21*a* is an air supply chamber 24. Another space between the balance piston 22 and the pressure control piston 23 is a balance chamber 25. A further space between pressure control piston 23 and the first separating wall 21*c* is a pressure control chamber 26. A pressure control handle 27 is screwed in the balance piston 22. A pressure control spring 28 is inserted between the pressure control handle 27 and the pressure control piston 23. The inner periphery of the case member 21 is provided with a step 21*e* which functions as a stop for the balance piston 22. An air supply port 29 communicates with the air supply chamber 24.

A space between the first separating wall 21*c* and the second separating wall 21*d* is an exhaust chamber 33 connected to the outside air via a port 34. The exhaust chamber 33 has the same axis as that of the pressure control chamber 26 and slidably accommodates a first valve member 32. A pressing spring 35 is provided between the first valve member 32 and the first separating wall 21*c*. The first valve member 32 abuts via sealants 37 a first valve seat 36 formed on the second separating wall 21*d*. The first valve member 32 is elevated from the first valve seat 36 by a rod 50 as described later.

The second separating wall 21*d* accommodates a second pressure chamber 38 which has the same axis as that of the exhaust chamber 33. The second pressure chamber 38 connects to the exhaust chamber 33. The second pressure chamber 38 further communicates with a first pressure chamber 39 formed between the second separated wall 21*d* and a bottom wall 21*b*. The first pressure chamber 39 accommodates a second valve member 40. The second valve member 40 can slide in a second valve chamber 52 provided in the bottom wall 21*b*. The second valve member 40 abuts via sealants 42 a second valve seat 41 formed on the second separating wall 21*d* by means of the pressing spring 51. The second valve member 40 detaches from the second valve seat 41 due to descent of the rod 50 described later. The second separating wall 21*d* is provided with ports 43 and 44 connecting with the second chamber 38. The first valve chamber 31 communicates with the second pressure chamber 38 via an air passage 32*a* formed in the first valve member 32. The second valve chamber 52 also connects with the second pressure chamber 38 via an air path 40*a* formed in the second valve member 40.

The rod 50 comprises a small diameter portion 50*a* and a large diameter portion 50*b* connected to each other at shoulder 50*c*. The small diameter portion 50*a* of the rod 50 is fixed to the pressure control piston 23. The small diameter portion 50*a* is airtightly and slidably inserted into the first separating wall 21*c*, and is slidably inserted into the first valve member 32. The shoulder 50*c* supports the bottom of the first valve member 32. The large diameter portion 50*b* is positioned inside the second pressure chamber 38. The end of the large diameter portion 50*b* contacts or separates from the top of the second valve member 40 in accordance with a movement of the pressure control piston 23.

The air supply chamber 24 communicates with a pneumatic electromagnetic valve having five ports and two positions 45 (hereinafter referred to as five port valve 45) via a port 29. The five port valve 45 connects to an air pressure supply 49. The pressure control chamber 26 communicates with a pneumatic electromagnetic valve having three ports and two positions 47 (hereinafter referred to as three port valve 47) via a port 46. The three port valve 47 is connected to the five port valve 45, and to the second pressure chamber 38 via the port 44. The first pressure chamber 39 communicates with the air pressure supply 49 via a port 48.

The port 43 of the pressure reducing valve 20 communicates with the rod port 16 of the pneumatic cylinder 10 via an air pathway 3. The second pressure chamber 38 of the pressure reducing valve 20 thus connects with the rod side chamber 14 of the pneumatic cylinder 10. The two-way valve 1 and the airflow control valve 2 mentioned above are positioned in parallel in the middle of the air pathway 3.

In the invention constructed as above, the five port valve 45 is powered and the three port valve is not powered while the load W is lowering at an ordinary speed. Specifically, the pressure control piston 23 is adjusted to a low pressure condition by a weak force on the pressure control springs 28. The second pressure chamber 38 communicates with the pressure control chamber 26 by the three port valve 47. Thus, the first valve member 32 is elevated, and the pressure in the second pressure chamber 38 is slightly lower than the pressure generated by the load W equilibrating with the weak force of the pressure control spring 28. A narrow gap is thus formed between the first valve member 32 and the first valve seat 36. In this condition, the air in the rod side chamber 14 of the pneumatic cylinder 10 is regularly exhausted out of the pressure reducing valve 20 by way of the two-way valve 1, the second pressure chamber 38, the exhaust chamber 33 and the port 34.

In case of any change of exterior force such as the lowering of the pressure generated by the pneumatic cylinder 10, the first valve member 32 closes the gap by yielding to the force of the pressure control springs 28, thereby stopping the load W. In this case, the two-way valve 1 is electrically closed. The five port valve 45 is left powered and the three port valve 47 is powered. The pressure control piston 23 of the pressure reducing valve 20 is thus elevated. Thus, the gap between the first valve member 32 and the first valve seat 36 is enlarged to attain an exhausting condition. Consequently, the air in the exhausting side chamber 14 of the pneumatic cylinder 10 flows easily, and a pre-determined amount of the air controlled by the airflow control valve 2 is exhausted by way of the pneumatic cylinder 10, the exhaust chamber 33 of the pressure reducing valve 20 and the port 34. The load W thus lowers at a pre determined diminishing speed.

Additionally, both the five port valve 45 and the three port valve 47 are not powered when the load W is elevated at a low speed. When the load W decelerates during rising or stops, the five port valve 45 is not activated and the three port 47 is activated. The pressure reducing valve 20 thus comes into an air supplying condition and the two-way valve is closed. Consequently, the load W is elevated at a pre-determined speed.

EMBODIMENT 2

Figure 2:
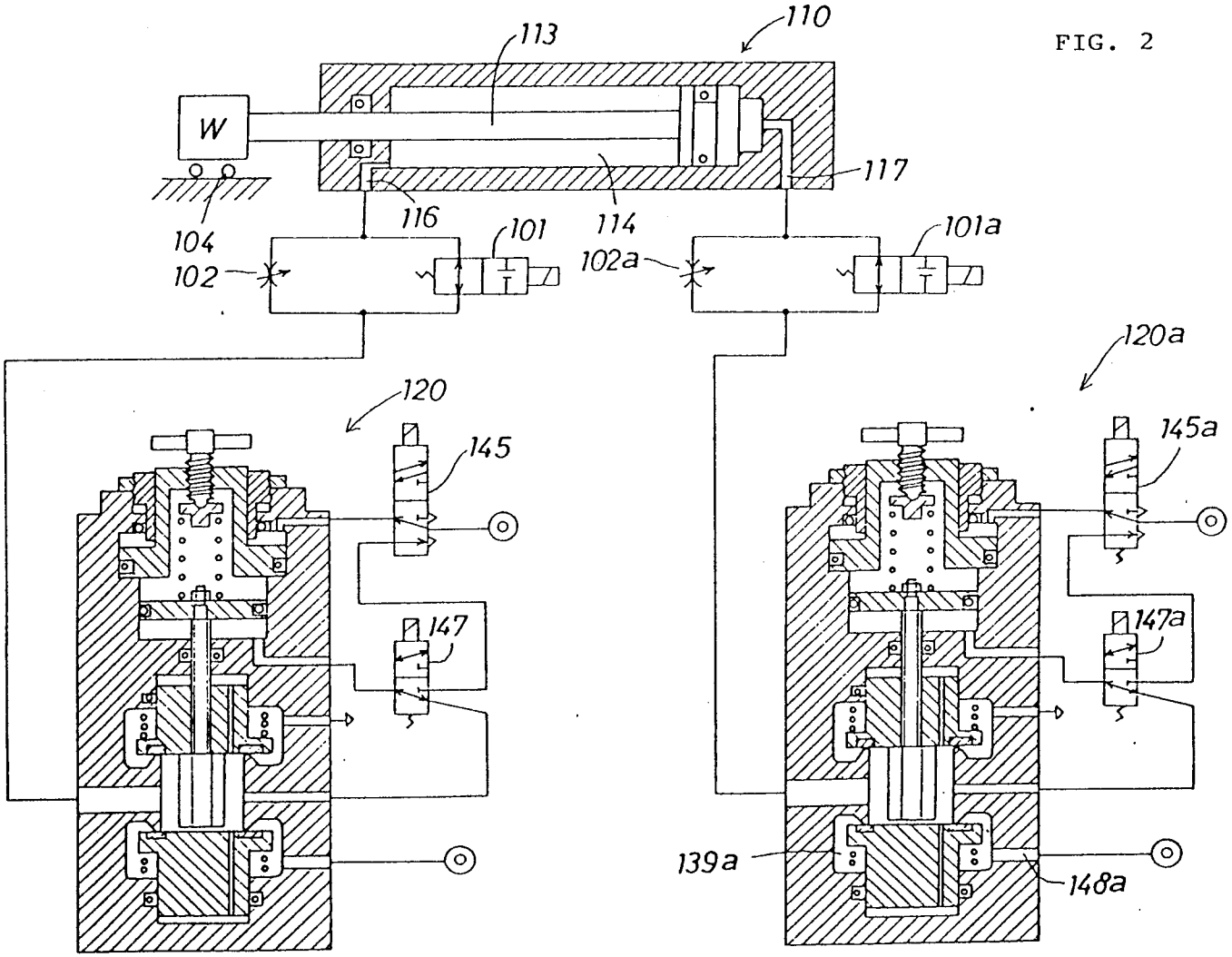
FIG. 2 is a front view of a second embodiment of the present invention.

FIG. 2 shows the second embodiment of the invention. In this embodiment, a pneumatic cylinder 110 is horizontally placed, and a load W is supported by rollers 104 and is connected to a rod 113 of the pneumatic cylinder 110. The load W can slide to the right and left as FIG. 2 is viewed. An exhaust port 116 of the pneumatic cylinder 110 communicates with a two way valve 101, an airflow control valve 102, and a high relief type pressure reducing valve 120. An intake part 117 communicates with a two-way valve 101*a*, an airflow control valve 102*a*, and a high relief type pressure reducing valve 120*a*. A suffix "a" is added to each reference character indicating the two-way valve, airflow control valve, and the components of the pressure reducing valve which connect with the intake port 117.

In FIG. 2, the load W slowly moves in the left direction. The high relief type pressure reducing valve 120*a* connected to the head side of the pneumatic cylinder 110 is adjusted to a high pressure condition. A five port valve 145*a* is not powered, while a three port valve 147*a* is powered. The pressure reducing valve 120 connected to the rod side of the pneumatic cylinder 110 is adjusted to a low pressure condition. A five port valve 145 is powered. A three port valve 147 is not powered. When the pressure conditions change due to any change of outer force and the movement of the load slows down or stops, the pressure reducing valve 120*a* is adjusted to an air supplying condition and both the five port valve 145*a* and the three port valve 147*a* are not activated. The pressure reducing valve 120 maintains the low pressure condition. The two-way valve 101 is electrically connected. Consequently, the air in a head side chamber 115 of the pneumatic cylinder 110 flows easily. The air is taken into the pressure reducing valve 120*a* through a port 148*a* of a first pressure chamber 139*a*, is then controlled by the airflow control valve 102*a*, and then flows into the pneumatic cylinder 110 at a pre-determined flow rate.

EMBODIMENT 3

Figure 3:
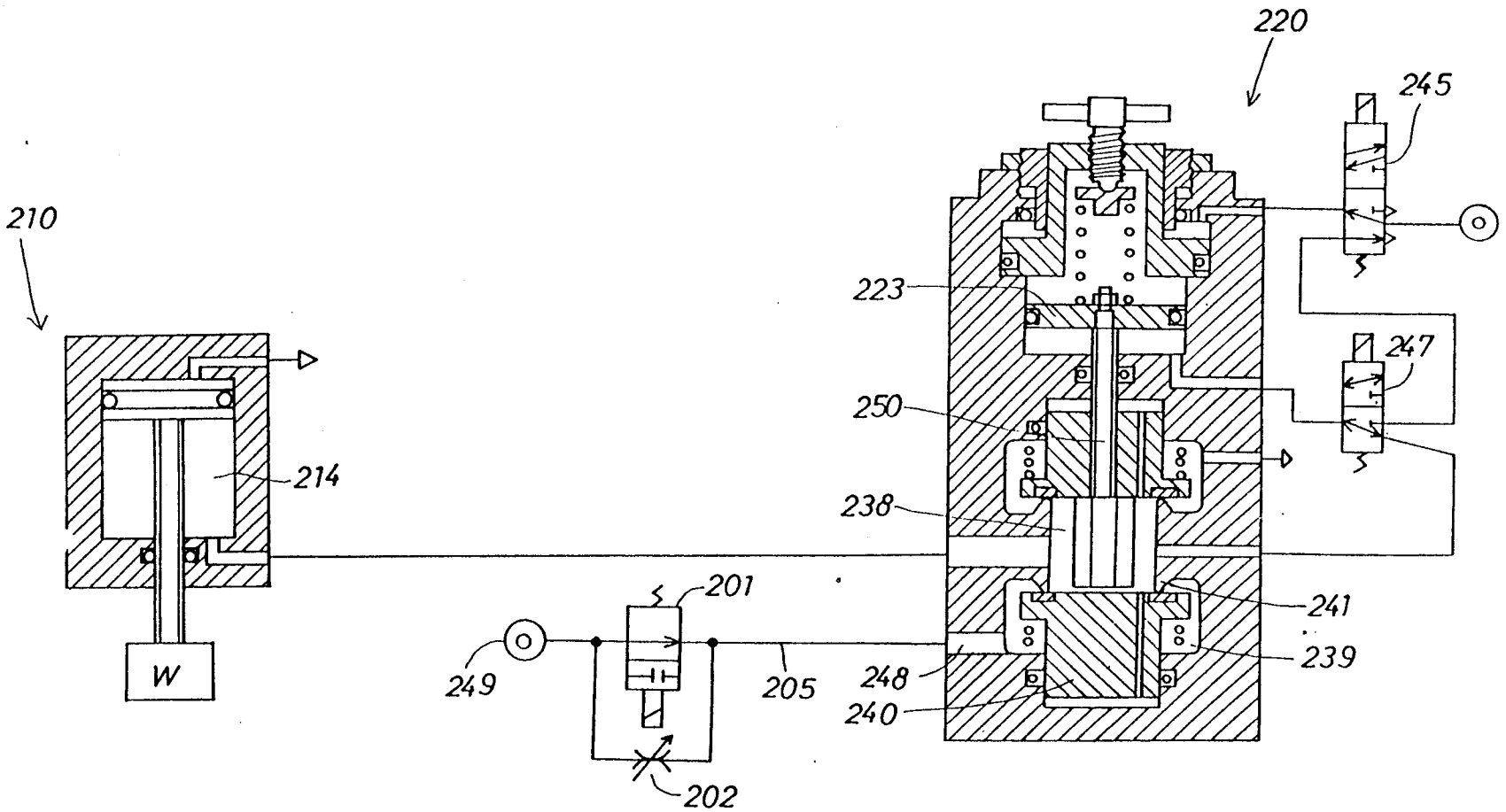
FIG. 3 is a front view of a third embodiment of the present invention.

FIG. 3 illustrates the third embodiment. This embodiment indicates the case when a load W is slowly elevated by a pneumatic cylinder 210. An air pathway 205 connects an air pressure supply 249 with a port 248 of a first pressure chamber 239 in a high relief type pressure reducing valve 220. A two type valve 201 and an airflow control valve 202 are positioned in parallel in the middle of the air pathway 205. A five port valve 245 and a three port valve 247 are not activated. Accordingly, the pressure control piston 223 is adjusted to a high pressure condition. The rod 250 lowers to push down the second valve member 240, thereby forming a narrow ga between the second valve member 240 and the second valve seat 241. The air from the air pressure supply 249 flows into an exhaust side chamber 214 of the pneumatic cylinder 210 by way of the two-way valve 201, the air pathway 205, the first pressure chamber 239, and a second pressure chamber 238. The load W is thus slowly elevated.

When the rising movement of the load W slows down or stops due to any change of outer force, the pressure reducing valve 220 is adjusted to an air supplying condition. The five port valve 245 is left turned off. The three port valve 247 is turned on. The two way valve is electrically connected. Accordingly, the gap between the second valve member 240 and the second valve seat 241 is enlarged and the air flows easily. The air from the air pressure supply 249 is controlled by the airflow control valve 202 and flows into the exhaust side chamber 214 of the pneumatic cylinder 210 by way of the air pathway 205, the first pressure chamber 239, and the second pressure chamber 238. The load is thus slowly elevated.

EMBODIMENT 4

Figure 4:
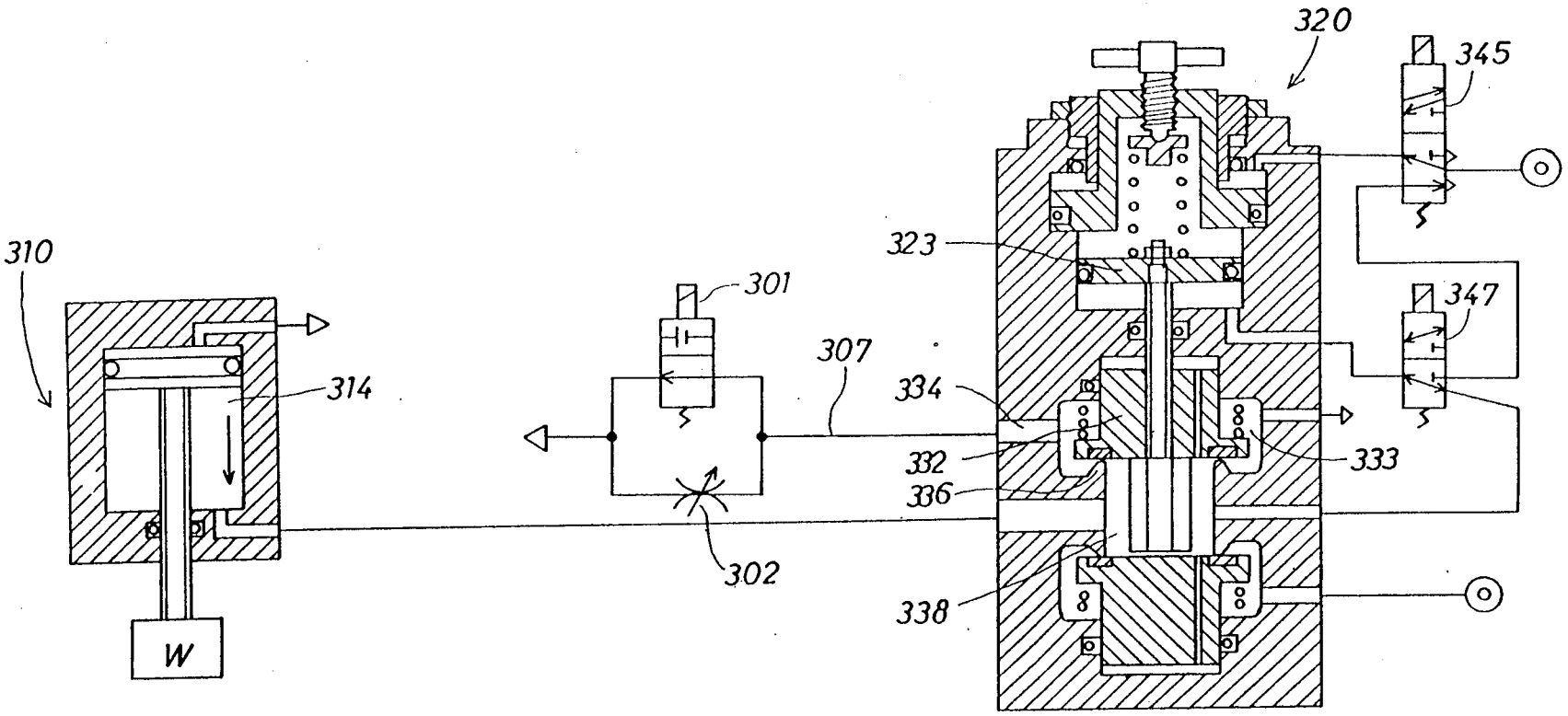
FIG. 4 is a front view of a fourth embodiment of the present invention.

FIG. 4 corresponds to the forth embodiment which is a modification of the first embodiment. In this embodiment, a pathway 307 communicates with a port 334 of an exhaust chamber 333 in a high relief type pressure reducing valve 320. A two-way valve 301 and an airflow control valve 302 are positioned in parallel in the middle of the air pathway 307. While the load W is slowly lowering as in the first embodiment, a five port valve 345 is activated and a three port valve 347 is not activated.

If the movement of the load W slows down or stops due to any change of outer force, the pressure reducing valve 320 is adjusted to an exhausting condition in the following manner: the two-way valve 301 is electrically connected; the five port valve 345 is left activated and the three port valve 347 is activated; the pressure piston 323 of the pressure reducing valve 320 is thus elevated; and the gap between a first valve member 332 and a first valve seat 336 is enlarged. Consequently, the air in an exhaust side chamber 314 in the pneumatic cylinder 310 flows easily. The air from the pneumatic cylinder 310 flows through a second pressure chamber 338, the exhaust chamber 333, and the port 334. The air is then controlled by the airflow control valve 302 and is exhausted from the pressure reducing valve 320 at a predetermined flow rate.

EMBODIMENT 5

Figure 5:
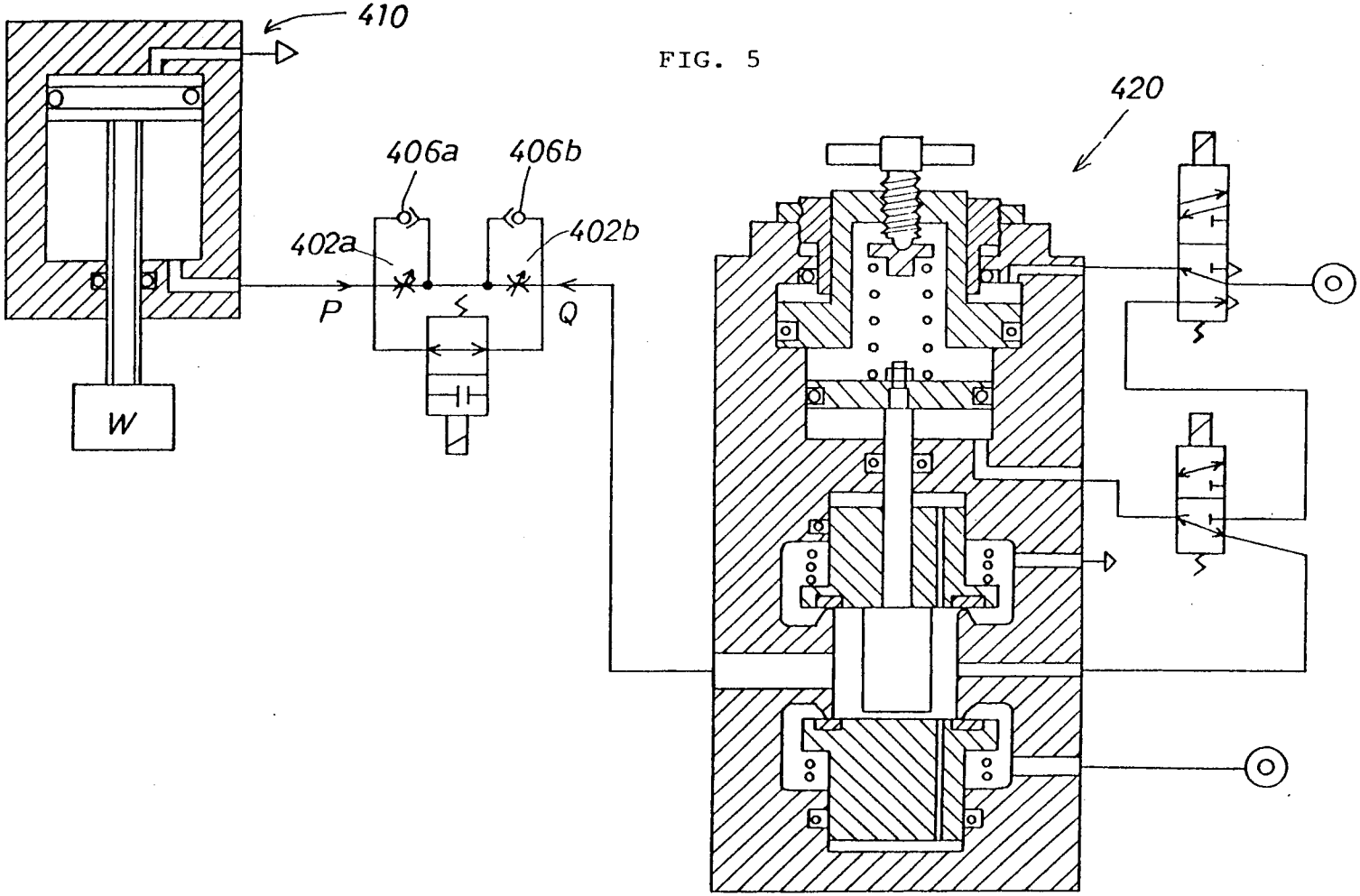
FIG. 5 is a front view of a fifth embodiment of the present invention.

FIG. 5 shows the fifth embodiment. In this embodiment, a pneumatic cylinder 410 enables a load W to go up and down. Air amount control valves 402*a* and 402*b* are connected in series instead of using only one as in Embodiment 1. Check valves 406*a* and 406*b* are placed in the positions parallel to the airflow control valves 402*a* and 402*b*, respectively. The check valves 406*a* and 406*b* face in opposite directions. When air from the pneumatic cylinder 410 flows in the direction of arrow P, i.e. the load W lowers, check valve 406*a* operates. When air from a high relief type pressure reducing valve 420 flows in the direction of arrow Q, i.e. the load W rises, check valve 406*b* operates. Since the action of the fifth embodiment is the same as that of the first or the third embodiment, it is not explained further herein.

EMBODIMENT 6

The sixth embodiment is explained with reference to FIG. 6. A speed control device of this embodiment is provided with a pressure accumulator 560 in a pilot line PL and a checking valve 570 located between the pressure accumulator 560 and a main line ML for preventing reverse airflow from the pilot line PL to the main line ML.

Figure 6:
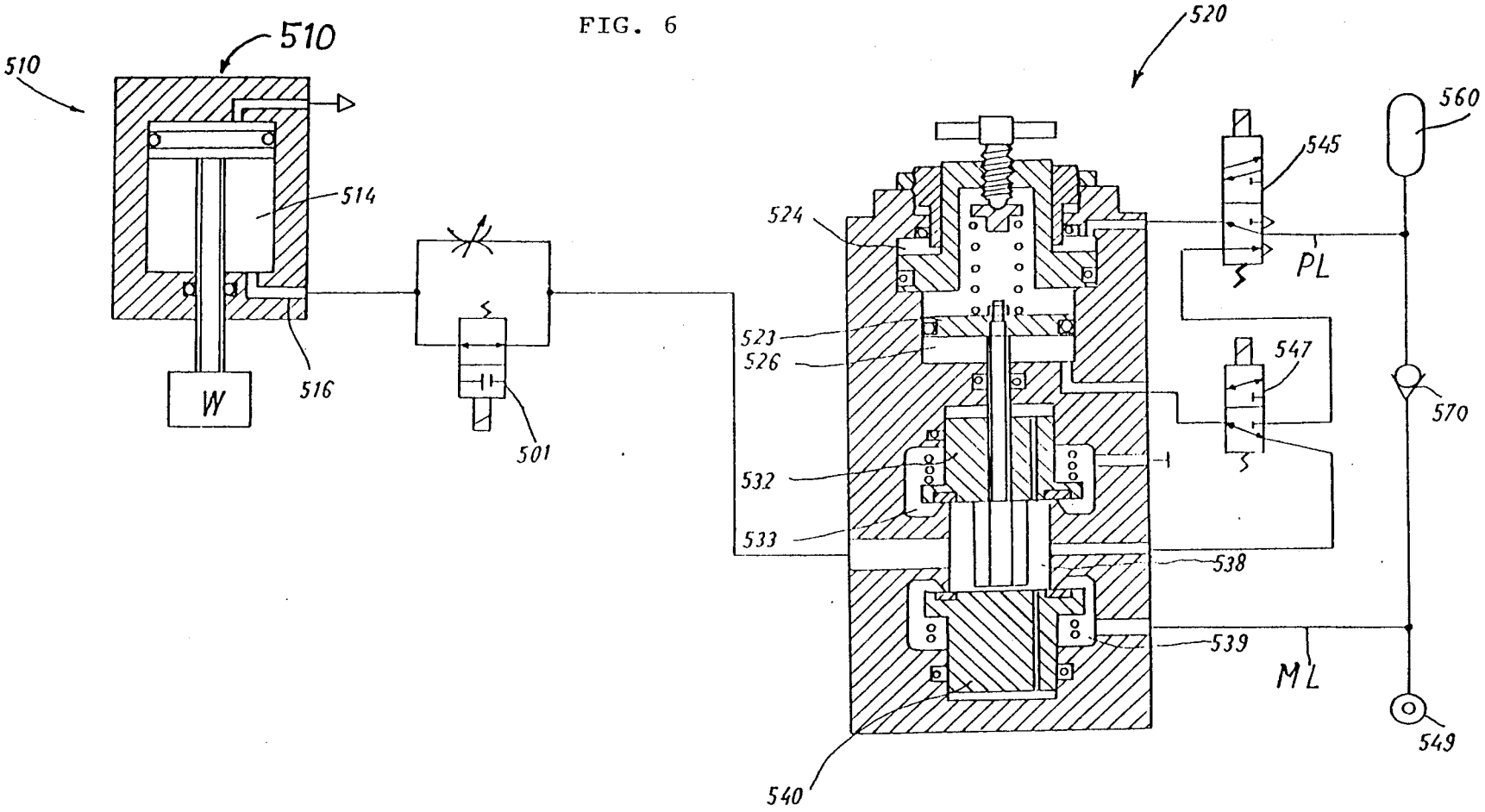
FIG. 6 is a front view of a sixth embodiment of the present invention.

The load W is elevated at a high speed in the FIG. 6. A five port valve 545 is not powered, a three port valve 547 is powered, and a two way valve 501 is powered. Since air pressure is supplied from an air pressure supply 549 via the line PL to an air supply chamber 524 and a pressure control chamber 526 is connected to the outside air, a pressure control piston 523 lowers to push down a second valve member 540 greatly. Thus, the air pressure supplied from the air pressure supply 549 via the line ML to a first valve chamber 539 flows into a rod side chamber 514 of a pneumatic cylinder 510 with great force, thereby elevating the load W at a high speed.

Apart from this control, the line PL is kept supplied with air pressure from the air pressure supply 549, and the pressure is accumulated in the pressure accumulator 560. When the air pressure in the line PL is below the fixed amount, the pressure accumulator 560 supplies the air pressure therein to the line PL.

When the load W is elevated fast in this embodiment, a shortage of air pressure in the line ML may occur even temporarily. In this case, air pressure is supplied from the pressure accumulator 560 to the line PL and does not flow into the line ML by means of the checking valve 570. Therefore, the air pressure in the line PL is maintained even if the air pressure is insufficient in the line ML, thereby controlling the pneumatic cylinder 520 in a normal manner.

Additionally, the five port valve 545, the three port valve 547, and the two way valve 501 are all powered when the load W lowers at a high speed. An air pressure is supplied from the air pressure supply 549 to the pressure control chamber 526. The pressure control piston 523 is thus elevated greatly to pull up a first valve member 532. Then a second pressure chamber 538 is connected with an exhaust chamber 533 to exhaust the air from the rod side chamber 514 of the pneumatic cylinder 510 quickly. Thus, the load W lowers at a high speed.

The action and effect of the sixth embodiment will become apparent in the following seventh embodiment.

EMBODIMENT 7

Figure 7:
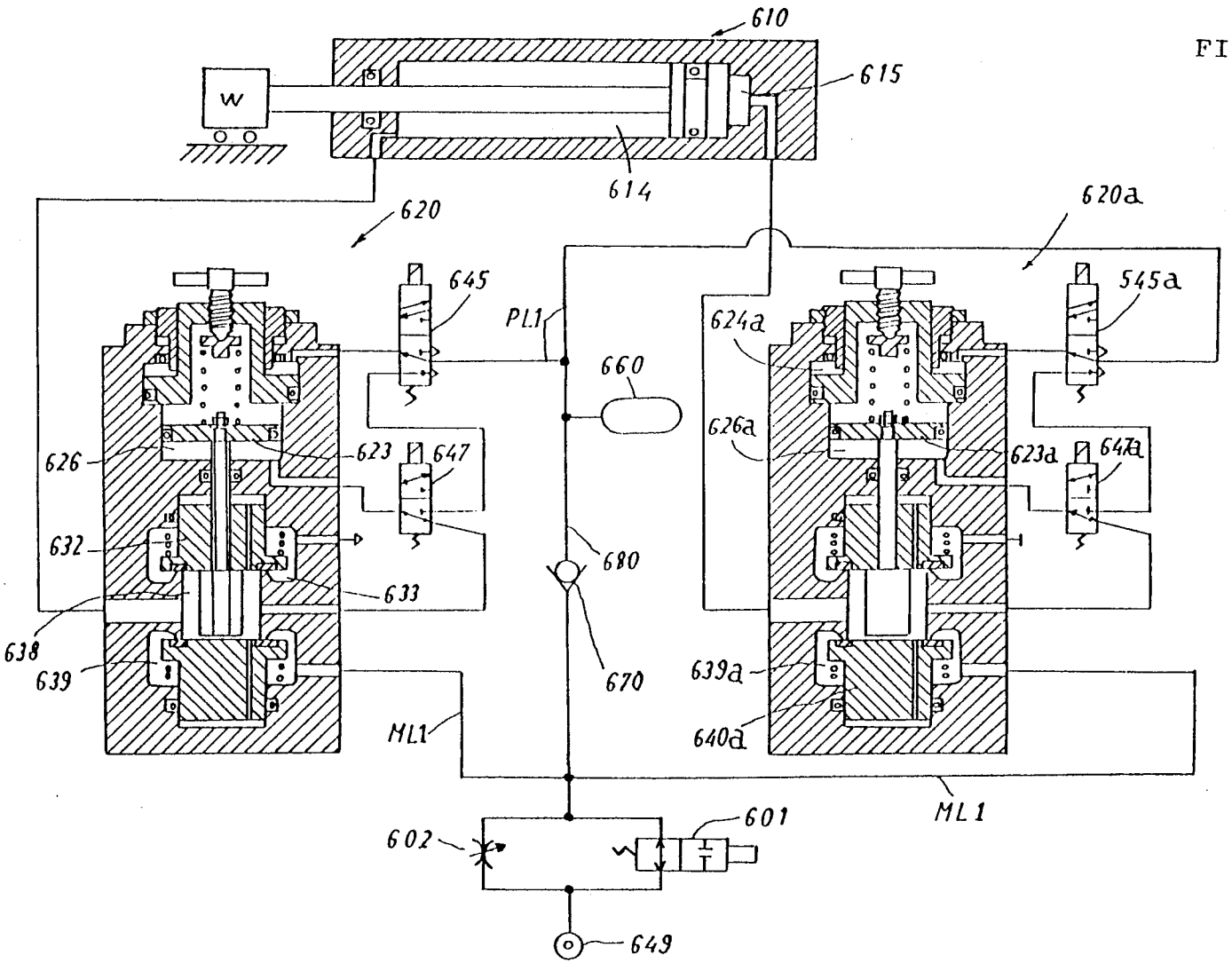
FIG. 7 is a front view of a seventh embodiment of the present invention.

The seventh embodiment is now described with reference to FIG. 7. This embodiment is a modification of the second embodiment. A main line ML1 connects an air pressure supply 649 and first pressure chambers 639 and **639*a* of high relief type pressure reducing valves 620 and 620*a*, respectively. A pilot line PL1 is connected to one of the ports of both five port valve 645 and 645*a*. A pressure accumulator 660 is provided in a branch line 680 between the line ML1 and the line PL1. A checking valve 670 is positioned in the branch line 680 between the pressure accumulator 660 and the line ML1. A parallel circuit of a two way valve 601 and an airflow control valve 602 is located between the line ML1 and the air pressure supply 649**.

The action and the effect of the speed control device of this embodiment are now described exemplifying slow and fast movements of the load W in the left direction.

In order to move the load W fast in the left direction, the five port valve 645 for controlling the pressure reducing valve 620 connected to a rod side chamber 614 is activated. The three port valve 647 is activated, whereas the five port valve **645*a* for controlling the other pressure reducing valve 620*a* is not activated. The three port valve 647*a* is activated, and the two way valve 601** is also activated.

In the pressure reducing valve 620 connected to the rod side chamber 614 set as above, air pressure is supplied from the air pressure supply 649 to the pressure control chamber 626 and a pressure control piston 623 is pushed up. A first valve member 632 thus goes up greatly. Then a second pressure valve 638 communicates with an exhaust chamber 633 to exhaust the air from the rod side chamber 614 of the pneumatic cylinder 610 quickly.

On the other hand, in the pressure reducing valve **620*a* connected to a head side chamber 615, air pressure is supplied from the air pressure supply 649 to an air supply chamber 624*a*, and a pressure control chamber 626*a* is open to the outside air. A pressure control piston 623*a* then lowers to push down a second valve member 640*a* greatly. As a result, the air pressure supplied from the air pressure supply 649 to the first pressure chamber 639*a* via the line ML1 flows into the rod side chamber 614 of the pneumatic cylinder 610 with great force. Therefore, the air is exhausted quickly from the rod side chamber 614 of the pneumatic cylinder 610 and the air is immediately supplied to the head side chamber 615**, thereby moving the load W in the left direction at a high speed.

If the moving speed of the load W is too high, the air pressure in the line ML1 may be insufficient. If this happens in a speed control device without the pressure accumulator 660 and the checking valve 670, the air pressure in the line PL1 also becomes scanty. In this case, in the pressure reducing valve 620 connected to the rod side chamber 614, the pressure supplied to the pressure control chamber 626 via the five port valve 645 and the three port valve 647 is too short to push up the pressure control piston 623. Thus, the second pressure chamber 638 and the exhaust chamber 633 are disconnected, preventing the air exhaustion from the rod side chamber 614. The load W stops the fast movement in the left direction. However, the air pressure in the head side chamber 615 and the line ML1 become sufficient, and the pressure in the line PL1 is then sufficient enough to move the load W at a high speed in the left direction. The same actions are repeated. As a result, the load W moves vibrantly at a high speed in the left direction, or in an extreme case, the load W may stop.

However, according to the seventh embodiment, the air pressure in the line PL1 is maintained by means of the pressure accumulator 660 and the checking valve 670 even when a shortage of the air pressure in the line ML1 occurs. Thus, the problem mentioned just above can be solved.

In order to move the load W slowly in the left direction, the five port valve 645 is powered, the three port valve is not powered, both the five port valve **645*a* and the three port valve 647*a* are not powered, and the two way valve 601 is powered. In the device of this embodiment set as above, the shortage of the air pressure in the line ML1 does not happen in principle. However, if the load W stops moving for some reason, the pneumatic cylinder 610 may be controlled by airflow instead of air pressure. In this case, the air pressure in the line ML1 automatically becomes insufficient. In the device without the pressure accumulator 660 and the checking valve 670, the load W stops when the pneumatic cylinder 610 is controlled by airflow. However, according to this embodiment, the air pressure in the line PL1** can be maintained, thereby causing no failure to move the load W.

As described in the sixth and seventh embodiments, the air pressure in the line PL1 is kept sufficient even when the load W moves at a high speed by providing the pressure accumulator 660 and the checking valve 670 between the lines ML1 and PL1. Therefore, the speed control device of this invention can attain stable controlling and a higher speed of the movement of the load W. Moreover, according to the seventh embodiment, a slow movement of the load W can be secured, and the load W never stops even when the pneumatic cylinder 610 is controlled by airflow.

The present invention may be subject to many modifications and changes without departing from the spirit or essential characteristics thereof.

Wherefore, having thus described the present invention, what is claimed is:

1. In a speed controlling apparatus for a pneumatic cylinder, including a pneumatic piston and a piston rod, having a pneumatic path comprising an air supply passage thereto and an air exhaust passage therefrom and including a high relief type pressure reducing valve having a first pressure chamber being connected with an air pressure supply, a second pressure chamber communicating with a first port of the pneumatic cylinder, and an exhaust chamber being connected to the environment, the improvement comprising:

a) control valve means for connecting and disconnecting the second pressure chamber to one of the first pressure chamber and the exhaust chamber, the second pressure chamber being connectable to a plurality of pressure level sources, and said control valve means varying a flow connection between the second pressure chamber and one of the first pressure chamber and the exhaust chamber when a slide resistance of the piston rod changes during the piston stroke due to an external force acting on the piston rod thereby to improve the speed control of the piston rod; and b) speed controlling means disposed in the pneumatic path for selectively changing a mode of operation therethrough from an air pressure to an air mass flow.

2. The improvement to a speed controlling apparatus for a pneumatic cylinder of claim 1 wherein:

said speed controlling means comprises a two-way valve and an airflow control valve positioned in parallel in the air supply passage.

3. The improvement to a speed controlling apparatus for a pneumatic cylinder of claim 1 wherein:

said speed controlling means comprises a two-way valve and an airflow control valve positioned in parallel in the air exhaust passage.

4. A speed control apparatus for a pneumatic cylinder having, a pneumatic piston and a piston rod, comprising:

a) a high relief type pressure reducing valve comprising, a1) a first pressure chamber being connected with an air pressure supply, a2) a second pressure chamber communicating with a first port of the pneumatic cylinder, and a3) an exhaust chamber being connected to the environment, wherein:

a4) said second pressure chamber is connectable to and disconnectable from said first pressure chamber and the exhaust chamber by a control valve and can attain a plurality of pressure controls;

wherein:

b) speed controlling means for the pneumatic cylinder are changeable from an air pressure to an air mass flow by a two-way valve and an airflow control valve positioned in parallel and disposed in series with one of an air supply passage into and an air exhaust passage out of the pneumatic cylinder;

c) said control valve varying a flow connection between the second pressure chamber and one of the first pressure chamber and the exhaust chamber when a slide resistance of the piston rod changes during the piston stroke due to an external force acting on the piston rod thereby to improve the speed control of the piston rod.

5. A speed control apparatus for a pneumatic cylinder having a piston rod supporting a movable piston therein, comprising:

a) a first high relief type pressure reducing valve and a second high relief type pressure reducing valve, each high relief type pressure reducing valve comprising, a1) a first pressure chamber being connected with an air pressure supply, a2) a second pressure chamber communicating with a port of the pneumatic cylinder, and a3) an exhaust chamber being connected to the environment, wherein:

a4) said second pressure chamber of each high relief type pressure reducing valve is connectable to and disconnectable from said first pressure chamber and the exhaust chamber by a control valve and can attain a plurality of pressure controls;

b) first speed controlling means for the pneumatic cylinder for changing from air pressure to air mass flow by a two-way valve and an airflow control valve positioned in parallel and disposed in series with an air passage from said first high relief type pressure reducing valve to the pneumatic cylinder on one side of the movable piston;

c) second speed controlling means for the pneumatic cylinder for changing from air pressure to air mass flow by a two-way valve and an airflow control valve positioned in parallel and disposed in series with an air passage from said second high relief type pressure reducing valve to the pneumatic cylinder on an opposite side of the movable piston; and d) at least one of the control valves of the two high relief type pressure reducing valves varying a flow connection between the second pressure chamber and one of the first pressure chamber and the exhaust chamber when a slide resistance of the piston rod changes during the piston stroke due to an external force acting of the piston rod thereby to improve the speed control of the piston rod.

6. A speed control apparatus for a pneumatic cylinder having a piston rod supporting a movable piston therein, comprising:

a) a first high relief type pressure reducing valve and a second high relief type pressure reducing valve, each high relief type pressure reducing valve comprising, a1) a first pressure chamber being connected with an air pressure supply, a2) a second pressure chamber communicating with a port of the pneumatic cylinder, and a3) an exhaust chamber being connected to the environment, wherein:

a4) said second pressure chamber of each high relief type pressure reducing valve is connectable to and disconnectable from said first pressure chamber and the exhaust chamber by a control valve and can attain a plurality of pressure controls;

b) first speed controlling means, for changing from an air pressure mode of operation to an air mass flow mode of operation, disposed in series with an air supply passage from said first high relief type pressure reducing valve to the pneumatic cylinder on one side of the movable piston:

c) second speed controlling means, for changing from an air pressure mode of operation to an air mass flow mode of operation, disposed in series with an air supply passage from said second high relief type pressure reducing valve to the pneumatic cylinder on an opposite side of the movable piston; and d) at least one of the control valve of the two high relief type pressure reducing valves varying a flow connection between the second pressure chamber and one of the first pressure chamber and the exhaust chamber when a slide resistance of the piston rod changes during the piston stroke due to an external force acting of the piston rod thereby to improve the speed control of the piston rod.

7. The speed control apparatus for a pneumatic cylinder of claim 6 wherein:

said first speed controlling means and said second speed controlling means each comprises a two-way valve and an airflow control valve positioned in parallel with said two-way valve.

8. A speed control apparatus for a pneumatic cylinder having a pneumatic piston and a piston rod, comprising:

a) a high relief type pressure reducing valve comprising, a1) a first pressure chamber being connected with an air pressure supply, a2) a second pressure chamber communicating with a port of the pneumatic cylinder, and a3) an exhaust chamber being connected to the environment, wherein:

a4) said second pressure chamber is connectable to and disconnectable from said first pressure chamber and the exhaust chamber by a control valve and can attain a plurality of pressure controls;

b) speed controlling means for changing the operation of the pneumatic cylinder from an air pressure mode to an air mass flow mode; and, c) said control valve varying a flow connection between the second pressure chamber and one of the first pressure chamber and the exhaust chamber when a slide resistance of the piston rod changes during the piston stroke due to an external force acting on the piston rod thereby to improve the speed control of the piston rod.

9. The speed control apparatus for a pneumatic cylinder of claim 8 wherein:

said speed controlling means comprises a two-way valve and an airflow control valve connected in parallel and disposed in series with an air supply passage into or an air exhaust passage out of the pneumatic cylinder.

10. A speed control device for a pneumatic cylinder having a pneumatic piston and a piston rod, comprising a high relief type pressure reducing valve connected to an air pressure supply via a main line and to supply and exhaust ports of the pneumatic cylinder, wherein:

the high relief type pressure reducing valve and the pneumatic cylinder are connected or disconnected by controlling valve members within the pressure reducing valve by means of air pressure supplied from a pilot line branching from the main line, a pressure accumulator is provided in the pilot line, a checking valve for preventing reverse airflow from the pilot line to the main line is provided between the pressure accumulator and the main line, and said controlling valve members varying a flow connection between the second pressure chamber and one of the first pressure chamber and the exhaust chamber when a slide resistance of the piston rod changes during the piston stroke due to an external force acting on the piston rod thereby to improve the speed control of the piston rod.

* * * * *